US005568735A

United States Patent [19]

Newkirk et al.

[11] Patent Number: 5,568,735

[45] Date of Patent: Oct. 29, 1996

[54] FOOD CONTAINER

[75] Inventors: J. Michael Newkirk, Round Rock, Tex.; David C. Overton, 16917 Dashwood Creek, Pflugerville, Tex. 78660

[73] Assignee: David C. Overton, Pflugerville, Tex.

[21] Appl. No.: 259,452

[22] Filed: Jun. 13, 1994

[51] Int. Cl.[6] ..... F25D 3/08

[52] U.S. Cl. ..... 62/457.7; 62/530; 62/371

[58] Field of Search ..... 62/371, 372, 457.2, 62/457.5, 457.6, 457.7, 529, 530, 458

[56] References Cited

U.S. PATENT DOCUMENTS

| | | | |
|---|---|---|---|
| 3,413,820 | 12/1968 | Paquin | 62/457.2 |
| 3,710,589 | 1/1973 | Brown et al. | 62/457.6 |
| 4,304,106 | 12/1981 | Donnelly | 62/457.6 |
| 4,570,454 | 2/1986 | Campbell | 62/457.3 |
| 4,981,234 | 1/1991 | Slaughter | 220/415 |
| 4,989,419 | 2/1991 | Brando et al. | 62/457.2 |
| 5,048,307 | 9/1991 | Baxter | 62/457.4 |
| 5,050,387 | 9/1991 | Bruce | 62/60 |
| 5,103,651 | 4/1992 | Coelho et al. | 62/341 |
| 5,271,244 | 12/1993 | Staggs | 62/457.3 |
| 5,345,784 | 9/1994 | Bazemore et al. | 62/371 |

OTHER PUBLICATIONS

Material Safety Data Sheet, Mid–Lands Chemical Company, Inc., for Anhydryde CoPolymer Based Formulation.

Material Safety Data Sheet, IPS Corporation, for Mixture of Organic Solvents.

*Primary Examiner*—Henry A. Bennett
*Assistant Examiner*—William C. Doerrler
*Attorney, Agent, or Firm*—Conley, Rose & Tayon

[57] ABSTRACT

Food or beverage container with two layers and a refrigerant material disposed between the two layers. The two layers have flanges outwardly disposed from the receptacle areas in the container. The two layers and/or flanges may be coupled together to form a liquid impervious seal. The refrigerant material may include a dye. A thermometer may be disposed in the refrigerant material or the receptacle area of the container.

17 Claims, 3 Drawing Sheets

FOOD CONTAINER

BACKGROUND OF THE INVENTION

1. Field of the Invention

This invention relates to an improved container for holding food, beverages, and other refrigerated items. These items are preferably maintained in the improved container at temperatures lower than ambient temperatures (e.g., lower than about 60° F. or 70° F.).

2. Description of the Related Art

Food and beverages have long been kept in insulated "coolers" or containers surrounded by ice, thereby maintaining the food and beverages at temperatures lower than ambient temperatures. The ice tends to melt relatively quickly, however, reducing the effectiveness of the cooler, and also potentially subjecting the food and beverages to a contaminating environment.

To address the melted ice problem, containers have been developed which separate the ice from the food or beverages. In addition, media or refrigerants other than ice (e.g., ethylene glycol, propylene glycol, amorphous natural high-polymer carbohydrates) have been used to absorb heat. For instance, U.S. Pat. No. 4,981,234 discloses a two layer container whereby an "amorphous high-polymer carbohydrate comprising long chains of glucose rings" is maintained between the layers. This patent is hereby incorporated by reference.

One disadvantage with two-layer containers such as described in U.S. Pat. No. 4,981,234 is that the refrigerant material may be harmful or distasteful to humans if ingested. As such, if the container holds food or beverages, any leakage of the refrigerant material may contaminant the food. Such leakage is more likely to occur at areas in the container whereby the two layers are joined together.

For instance, in FIG. 3 of U.S. Pat. No. 4,981,234 the two layers are joined together with an inclined inner ridge 21, the underside of which is engaged by an outer projection or ridge 22 on the inner shell 10. In addition, a flange-like extension 23 on the inner shell 10 rests on the upper edge of the outer shell 11. Since the connection area between the two layers in U.S. Pat. No. 4,981,234 is at or near the top of the container, and since leakage tends to occur at the connection area, any leakage that might occur may find its way into the interior of the container, thereby contaminating the food and/or beverages within.

Another potential disadvantage of the system to connect the two layers in U.S. Pat. No. 4,981,234 is that it relies upon mechanical sealing to prevent leakage. When the container is stressed (for instance, during movement), or subjected to thermal expansion (for instance, if left in the sun on a hot day), then the mechanical connection system disclosed in this patent may fail.

SUMMARY OF THE INVENTION

The invention is directed to a container adapted to maintain food or beverage at temperatures lower than ambient temperature for relatively long periods of time during use. This container includes an inner layer shaped to form a food or beverage receptacle area. This inner layer includes a bottom portion connected to one or more walls. The walls include one or more top portions that are connected to a flange extending outwardly from the receptacle area.

The container also includes an outer layer substantially surrounding the inner layer. The outer layer includes a bottom connected to one or more walls. The outer layer is spaced apart from the inner layer to form a cavity. The cavity may extend into all or part of the bottom or the walls, including the top portion of the walls. The cavity may include compartments and/or ridges throughout it for structural support.

The walls of the outer layer also include one or more top portions; these top portions being connected to one or more flanges extending outwardly from the receptacle area. The first and second flanges are adjacent one another, and preferably coupled to one another.

A refrigerant material is disposed in all or part of the cavity during use. The refrigerant material is adapted to, when frozen, maintain food placed in the container at a temperature less than ambient temperature.

An adhesive may be placed between the flanges of the two layers, thereby coupling the two flanges together to form a liquid impervious seal.

The wall of the inner layer may be bent outwardly from the receptacle area, thereby forming a ledge, and/or a top portion adjacent to the top portion of the outer layer. At least part of the top portions of the inner and outer layers are substantially vertically aligned, these parts being connected to the flanges. An adhesive may be placed between the substantially vertically aligned parts of the top portions, thereby coupling the two top portions together to form a liquid impervious seal.

The container may further be equipped with temperature wells and gauges, and ports for emptying or adding refrigerant material.

DESCRIPTION OF PREFERRED EMBODIMENTS

Figure 1:
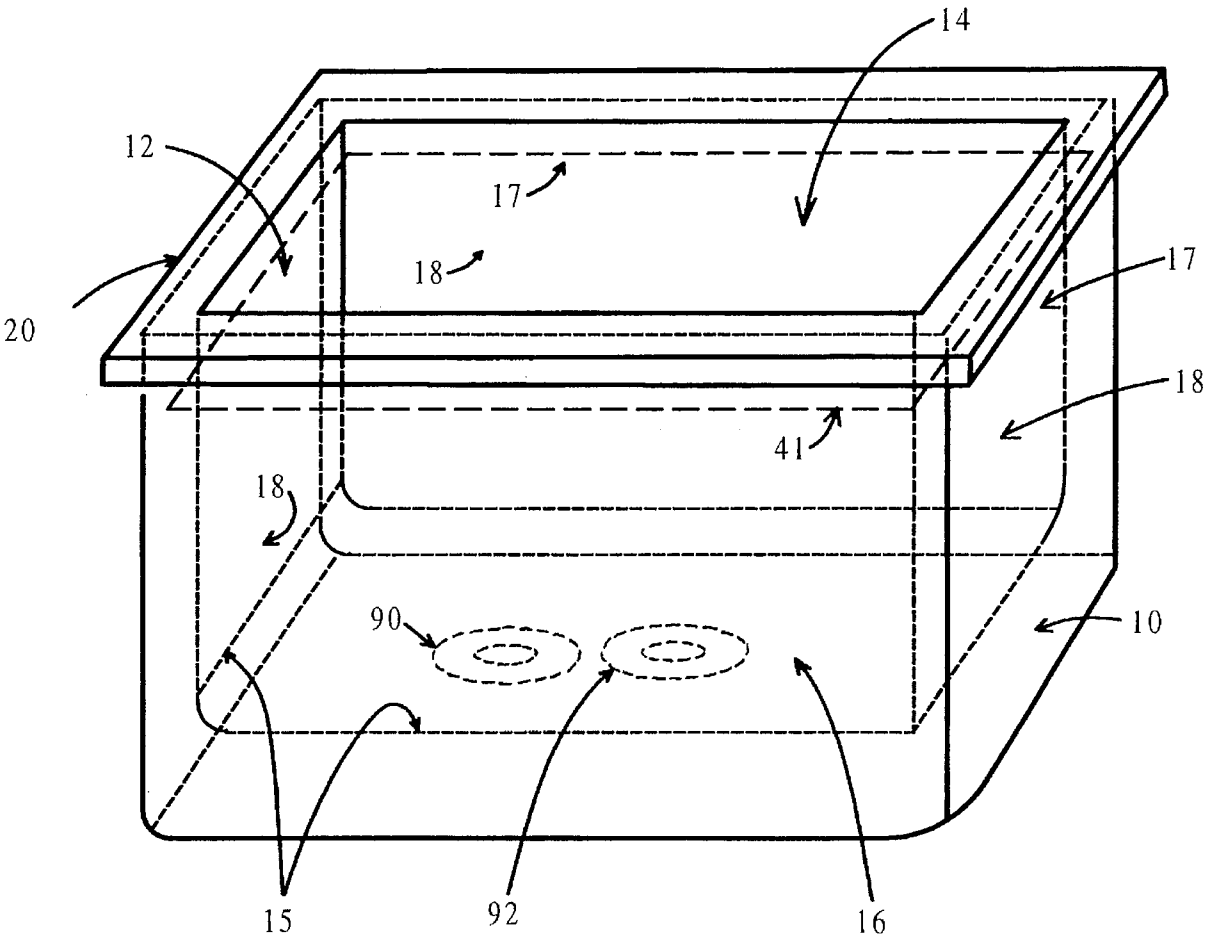
FIG. 1 depicts a container adapted to maintain food or beverage at temperatures lower than ambient temperature for relatively long periods of time during use.
Figure 2:
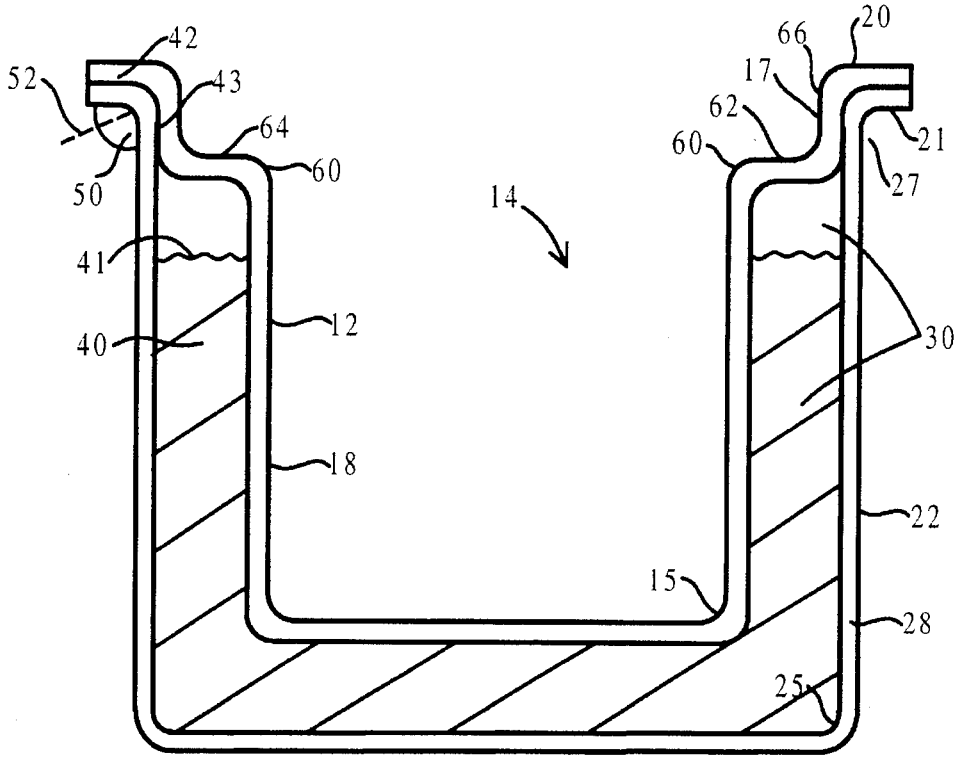
FIG. 2 depicts a cross-section view of a container adapted to maintain food or beverage at temperatures lower than ambient temperature for relatively long periods of time during use.
Figure 3:
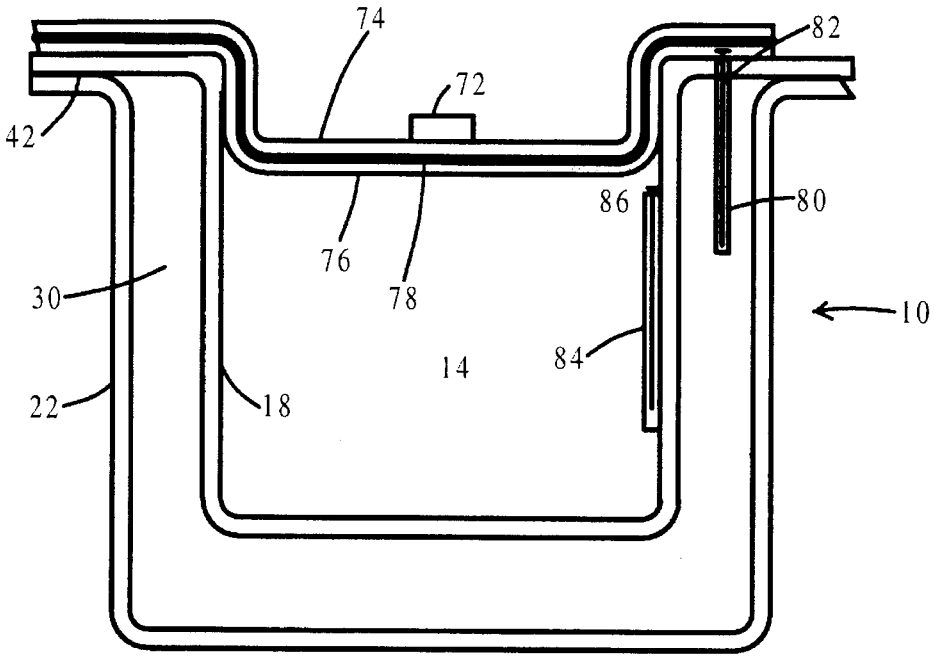
FIG. 3 depicts a cross-section view of a container adapted to maintain food or beverage at temperatures lower than ambient temperature for relatively long periods of time during use.

In FIGS. 1–3, the container 10 includes an inner layer 12 shaped to form a food or beverage receptacle area 14. The inner layer 12 includes a bottom portion 15 connected to the walls 18. The walls includes top portions 17. The top portions 17 are connected to flanges 20 extending outwardly from the receptacle area 14.

Container 10 also includes an outer layer 22 substantially surrounding the inner layer 12, the outer layer 22 including a bottom portion 25 connected to walls 28. The outer layer 22 is preferably spaced apart from inner layer 22 to form a cavity 30. The walls 28 include top portions 27, with these top portions 27 being connected to a second flange 21 extending outwardly from the receptacle area 14, the flange 20 and the flange 21 being adjacent to one another.

A refrigerant material 40 is disposed in the cavity 30 to a level 41 during use. The refrigerant material 40 is adapted to, when subjected to temperatures less than ambient temperature (e.g., temperatures about the freezing point of water), maintain food placed in the container 10 at a temperature less than ambient temperature.

The container 10 preferably includes a liquid impervious seal 42 between the flanges 20 and 21 and coupling these two flanges together. This seal 42 may be formed by adhering these flanges together with an adhesive such as a hot melt adhesive or glue. In a preferred embodiment the glue used was ACRYLIE solvent cement, made by PSI Corp. (Gardena, Calif.).

Preferably at least part of the first top portion 17 is adjacent at least part of the top portion 27. In an alternate embodiment an adhesive may be placed between the top portions 17 and 27, thereby coupling them together to form a liquid impervious seal 43.

Preferably an angle 50 formed by the outer layer 22 and the flange 21 is about 90 degrees. In this manner refrigerant material does not tend to migrate into any spaces between the flanges. In addition, with about a 90 degree angle the flanges form a lip for grasping the container 10.

In an alternate embodiment, as shown by line 52 in FIG. 2, the angle 50 is about 60 degrees. The same advantages as for a 90 degree angle are present, with the added benefit that the lip tends to be less likely to slip from the grasp of a person holding the container 10.

In an alternate embodiment the angle 50 is above 90 degrees (e.g. about 90–100 degrees). In this embodiment a substantially horizontal lip is formed, and any refrigerant material that migrates to the lip falls by gravity back into the cavity, instead of potentially leaking out between the flanges.

One advantage of the flanged arrangement shown in the figures is that the refrigerant material is sealed from the receptacle area. As such, unless the layers themselves fail (which is less likely than a leak at a seal), refrigerant material can only leak out between the flanges. In Such a leak, however, the refrigerant material would leak outside of the receptacle area, thereby avoiding any contamination of food or beverage by refrigerant material.

As shown in FIG. 2, in a preferred embodiment the container 10 may have walls 18 that includes bends 60. In this manner the walls 18 may form one or more substantially horizontal ledges 62 (one or more of these ledges can be closer or further from the bottom than shown in the figures), or simply angle upwards as shown by section 64. Ledges 62 may be useful for placing different food or beverage at different levels within the container 10. Since these different levels will generally be at different temperatures (especially in the container is uncovered), providing such ledges allows for different temperature gradients to be maintained within one container. In either case preferably the top portions of the two layers ultimately become adjacent to one another, as shown by section 66 in FIG. 2. Preferably these two portions also become substantially vertically aligned. The parts of the top portions which are substantially vertically aligned may also be connected to the flanges 20 and 21. Finally, an adhesive may be placed between the substantially vertically aligned parts of the top portions, thereby coupling these two top portions together to form a liquid impervious seal.

In a preferred embodiment the walls, bottom and lid of the container may be made of plastic such as white LUSTRAN ABS 752 resin, made by Monsanto Chemicals (Fort Worth, Tex.).

In a preferred embodiment the refrigerant material includes an anhydride copolymer gel. One such refrigerant may be Polar Pack polymer, available from Mid-Lands Chemical Company, Inc. (Omaha, Nebr.).

The refrigerant material may also include a dye such as food coloring. In this manner leaks of the refrigerant material may be readily ascertained, thus preventing unknowing ingestation of refrigerant material that may have leaked from the cavity 30.

As shown in FIG. 3, the container 10 may also include a cover or lid 70 with a handle 72. The lid 70 may include layers 74 and 76, which also contain a cavity 78 therebetween. Cavity 78 may be at least partially filled with a refrigerant material 40. A lid 70 with refrigerant between two layers inhibits temperature rise within the container.

Container 10 may also include a thermometer well 80 which extends into the cavity 30. Well 80 is thus proximate to, and preferably surrounded by, refrigerant material. A thermometer 82 is preferably placed in the thermometer well 80. In this manner the temperature of the refrigerant material may be monitored. The container 10 may be inserted into a cold environment (to recool or refreeze the refrigerant material) when the temperature of the refrigerant material rises above a selected temperature. Thus contamination or spoilage of food/beverage in the container, which is sometimes caused if the temperature rises about a certain level, can be prevented. A temperature well 84, and a thermometer 86, may also be placed within the receptacle area 14. This thermometer 86 may more closely measure temperatures in the receptacle area 14, thus allowing close monitoring of food/beverage temperatures.

As shown in FIG. 1, the container 10 may further contain a sealable opening 90. The sealable opening 90 may be in the bottom (or sides) of the container 10 and may be adapted for emptying or filling the cavity 30 with the refrigerant material. A second sealable opening 92 may be in communication with the receptacle area, thereby allowing drainage of the receptacle area to outside the container 10.

Figure 4:
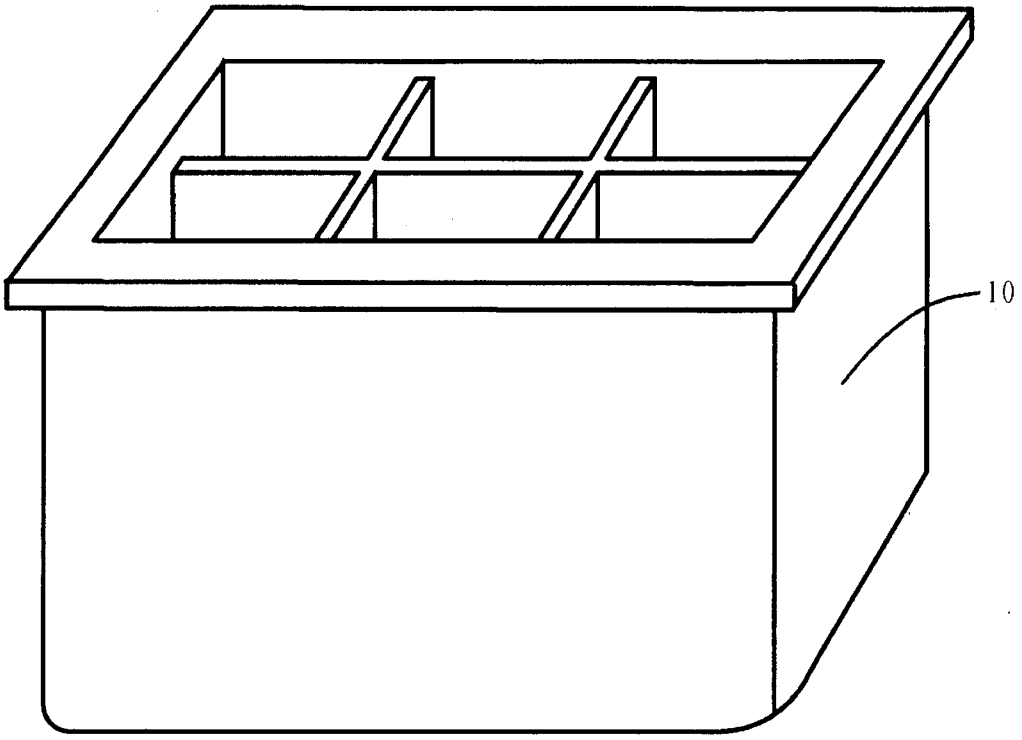
FIG. 4 depicts a multi-compartment container adapted to maintain food or beverage at temperatures lower than ambient temperature for relatively long periods of time during use.
Figure 5:
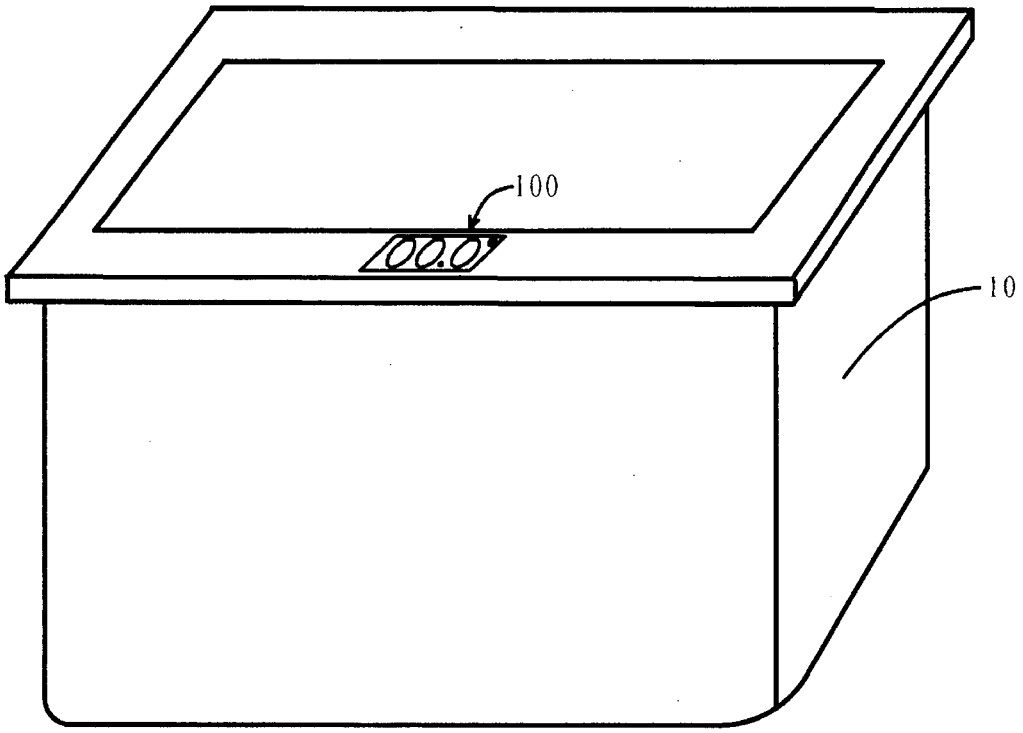
FIG. 5 depicts a container with a temperature gauge, the container being adapted to maintain food or beverage at temperatures lower than ambient temperature for relatively long periods of time during use.

As shown in FIG. 4, the container 10 may be partitioned into multiple compartments. FIG. 5 is a depiction of a container 10 with a digital gauge 100 mounted on the top of the container. The gauge 10 is connected to a thermometer to measure the temperature of the refrigerant material in the cavity 30.

In a preferred embodiment a container such as shown in FIG. 1 was filled with Polar Pack refrigerant material and adapted with an insulated cover without any refrigerant material within it. The container was placed in a freezer at temperatures of about 15° F. below zero, and the refrigerant material was frozen. The container was removed and placed in an environment of about 75° F. Standard one ounce packets of "half-and-half" coffee creamer at about 35° F. were placed within the container. The container maintained the temperature of the coffee creamer at about 40° F. for at least about 8 hours when the container was left in the 75° F. environment.

In a second experiment the same container was tested in a similar manner with "chicken" batter (i.e., equal parts of white, wheat, and oat flour mixed together in liquid form) at an initial temperature of 60° F. The container maintained the temperature of the "chicken" batter at about 34° F. for at least about 5 hours.

In a third experiment chicken meat and beef meat at about 40° F. were placed in separate ordinary single layer CAMBRO brand containers, and both containers were placed in an refrigerated "line" receptacle in a restaurant. The "line" receptacle was set to maintain an inside temperature of 45° F. The "line" receptacle was repeatedly opened and closed during operation as food was inserted and removed from it. Ambient temperature was about 75° F. After one hour, the temperature of the beef was 49° F., and the chicken temperature was 48.9° F. Some of the same chicken meat, along with some marinated chicken meat, were also simultaneously placed in a container described for the above experiments, and this container was also simultaneously used as a "line" receptacle in the same restaurant. After one and one-half hours, the temperature of the chicken in this container dropped to 36° F. and the marinated chicken meat temperature dropped to 38° F. The temperature of the chicken meat then stayed below 40° F. for 6–8 hrs.

At the present time, Health Department rules for cold foods state that the foods must be held at 45° F. or below. These rules may be changed to require that foods be held at 40° F. or below. Thus the invention may be more important as Health Department rules become more strict.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements and compositions described herein or in the features or in the sequence of features of the methods described herein without departing from the spirit and scope of the invention as described in the following claims.

We claim:

1. A container adapted to maintain food or beverage at temperatures lower than ambient temperature for relatively long periods of time during use, comprising:

an inner layer shaped to form a food or beverage receptacle area, the inner layer comprising a first bottom portion connected to a first wall, the first wall comprising a first top portion, and the first top portion being connected to a first flange extending outwardly from the receptacle area;

an outer layer substantially surrounding the inner layer, the outer layer comprising a second bottom portion connected to a second wall, the outer layer being spaced apart from inner layer to form a cavity, and the second wall comprising a second top portion, the second top portion being connected to a second flange extending outwardly from the receptacle area, the first and second flanges being adjacent one another;

a refrigerant material disposed in the cavity during use, the refrigerant material being adapted to, when subjected to temperatures less than ambient temperature, maintain food placed in the container at a temperature less than ambient temperature;

an adhesive placed between the first and second flanges and coupling the two flanges together to form a liquid impervious seal; and a thermometer well in the cavity, the well being proximate to the refrigerant material.

2. The container of claim 1 wherein at least part of the first top portion is adjacent at least part of the second top portion.

3. The container of claim 2, further comprising an adhesive placed between the first and second top portions and coupling the two top portions together to form a liquid impervious seal.

4. The container of claim 1 wherein an angle formed by the outer layer and the second flange is about 60–90 degrees.

5. The container of claim 1 wherein an angle formed by the outer layer and the second flange is about 90–100 degrees.

6. The container of claim 1, wherein the wall of the inner layer is bent outwardly from the receptacle area, thereby forming a part of the first top portion adjacent to a part of the second top portion, and wherein at least part of the first and second top portions are substantially vertically aligned.

7. The container of claim 6 wherein the parts of the first and second top portions which are substantially vertically aligned are connected to the first and second flanges.

8. The container of claim 6, further comprising an adhesive placed between the substantially vertically aligned parts of the first and second top portions and coupling the two top portions together to form a liquid impervious seal.

9. The container of claim 6 wherein the wall of the inner layer bends to form a substantially horizontally aligned area, and then further bends to form the substantially vertically aligned portion of the inner layer.

10. The container of claim 1 wherein the refrigerant comprises an anhydride copolymer gel.

11. The container of claim 1 wherein the refrigerant comprises a dye.

12. The container of claim 1, further comprising a lid adapted to cover the receptacle area, the lid comprising two layers with a cavity therebetween, the cavity being at least partially filled with a refrigerant material.

13. The container of claim 1 wherein the container is adapted to maintain coffee creamer at 40 F. for at least about 10 hours.

14. The container of claim 1 wherein the container is adapted to maintain egg batter at 34 F. for at least about 5 hours.

15. The container of claim 1, further comprising a sealable opening in the second bottom, the opening being adapted for emptying or filling the cavity with the refrigerant material.

16. The container of claim 1, further comprising a thermometer in the thermometer well.

17. A container adapted to maintain food or beverage at temperatures lower than ambient temperature for relatively long periods of time during use, comprising:

an inner layer shaped to form a food or beverage receptacle area, the inner layer comprising a first bottom portion connected to a first wall, the first wall comprising a first top portion, and the first top portion being connected to a first flange extending outwardly from the receptacle area;

an outer layer substantially surrounding the inner layer, the outer layer comprising a second bottom portion connected to a second wall, the outer layer being spaced apart from inner layer to form a cavity, and the second wall comprising a second top portion, the second top portion being connected to a second flange extending outwardly from the receptacle area, the first and second flanges being adjacent one another;

a refrigerant material disposed in the cavity during use, the refrigerant material being adapted to, when frozen, maintain food placed in the container at a temperature less than ambient temperature;

an adhesive placed between the first and second flanges and coupling the two flanges together to form a liquid impervious seal; and wherein the wall of the inner layer is bent outwardly from the receptacle area, thereby forming a part of the first top portion adjacent to a part of the second top portion. and wherein at least part of the first and second top portions are substantially vertically aligned, and the parts of the first and second top portions which are substantially vertically aligned are connected to the first and second flanges, and further comprising an adhesive placed between the substantially vertically aligned parts of the first and second top portions and coupling the two top portions together to form a liquid impervious seal.

* * * * *